US005971516A

United States Patent [19]

Huber

[11] Patent Number: 5,971,516

[45] **Date of Patent: *Oct. 26, 1999**

[54] DRAWER WITH IMPROVED CONNECTION BETWEEN DRAWER SIDE AND DRAWER BASE

[75] Inventor: Edgar Huber, Hard, Austria

[73] Assignee: Julius Blum Gesellschaft m.b.H., Höchst, Austria

[ * ] Notice: Under 35 U.S.C. 154(b), the term of this patent shall be extended for 73 days.

[21] Appl. No.: 08/587,931

[22] Filed: Jan. 17, 1996

[30] Foreign Application Priority Data

Jan. 19, 1995 [AT] Austria ..... 76/95

[51] Int. Cl.[6] ..... A47B 88/00

[52] U.S. Cl. ..... 312/348.1; 312/265.5

[58] Field of Search ..... 312/348.1, 348.2, 312/348.4, 265.6, 265.5

[56] References Cited

U.S. PATENT DOCUMENTS

| | | | |
|---|---|---|---|
| 3,610,719 | 10/1971 | Alston | 312/348.1 X |
| 3,876,270 | 4/1975 | White | 312/348.1 |
| 4,162,114 | 7/1979 | Litchfield et al. | 312/348.1 X |
| 4,322,572 | 3/1982 | Snyder | 312/265.5 X |
| 5,348,386 | 9/1994 | Grass | 312/348.2 |
| 5,439,285 | 8/1995 | Lautenschlager | 312/348.1 |

FOREIGN PATENT DOCUMENTS

| | | | |
|---|---|---|---|
| 3911-353A | 10/1990 | Denmark | 312/348.1 |
| 93 18 382 | 2/1994 | Germany . | |
| 2087715 | 6/1982 | United Kingdom | 312/348.1 |

*Primary Examiner*—Peter M. Cuomo
*Assistant Examiner*—Stephen Vu
*Attorney, Agent, or Firm*—Wenderoth, Lind & Ponack, L.L.P.

[57] ABSTRACT

A drawer includes a front panel and two drawer sides which are joined to the front panel by fixing devices and which have lateral U-shaped profiles with upper and lower horizontal flanges for accommodating a drawer base. The under side of the drawer base is provided, in regions of the U-shaped profiles with grooves into which fit projections of the lower horizontal flanges. The drawer has a rear wall. Each lower horizontal flange has only a single projection projecting into the respective groove thereabove. Such projection is at or close to a front end of the horizontal flange. During assembly of the drawer, the drawer sides are pushed laterally onto the drawer base, so that the projections of the lower horizontal flanges of the drawer sides project into the grooves thereabove in the drawer base. Rear ends of the drawer sides are diverged. The rear wall is then inserted between the drawer sides, and thereafter the drawer sides are pushed towards one another until the rear ends thereof snap into the rear wall. The projections serve as axes of rotation during these movements. The front panel is then anchored to the drawer sides by the fixing devices.

6 Claims, 11 Drawing Sheets

4
10
18
58
55
35
54
5
13
62
49
52
29
9
30
8
3
12
46
45
50
61
2
53
59
60
16

DRAWER WITH IMPROVED CONNECTION BETWEEN DRAWER SIDE AND DRAWER BASE

BACKGROUND OF THE INVENTION

The invention relates to a drawer having a front panel, two drawer sides which are joined to the front panel by means of fixing devices and have lateral U-shaped members profiles with upper and lower horizontal bars or flanges for accommodating a drawer base which, in the region of the U-shaped profiles, is provided with grooves on its underside, into which project projections of the lower horizontal bars or flanges, and a rear wall.

The invention furthermore relates to a method of assembling such a drawer.

SUMMARY OF THE INVENTION

The object of the invention is to provide a drawer, the individual components of which can be combined rationally, and to provide a method for assembling such a drawer.

The object according to the invention is achieved by each drawer side having, on a lower horizontal bar or flange a lateral U-shaped profile or member, only a single projection which projects into a groove thereabove and provided in a drawer base. The projection is at or close to the front end of the horizontal bar or flange.

In one method according to the invention, the drawer sides are pushed laterally onto the drawer base, so that the projections of the lower horizontal bars or flanges of the drawer sides project into the grooves above them in the drawer base. The drawer sides diverge to the rear, and the rear wall is inserted between the drawer sides. The drawer sides thereafter are turned or moved towards one another until rear ends of the drawer sides snap into the rear wall, the projections serving as axes of rotation. The front panel then is anchored to the drawer sides by means of fixing devices.

In another method according to the invention, the drawer sides are anchored to the front panel by means of the fixing devices, the drawer base thereafter is pushed into the lateral U-shaped profiles of the drawer sides so that the projections of the horizontal bars or flanges of the drawer sides project into the grooves above them, and the rear ends of the drawer sides are swivelled outwardly. The rear wall then is inserted between the drawer sides, after which the rear ends of the drawer sides are pushed against the ends of the rear wall and anchored thereto, the projections serving as axes of rotation.

BRIEF DESCRIPTION OF THE DRAWINGS

Various embodiments of the invention are described in detail below with reference to the accompanying drawings, wherein.

DETAILED DESCRIPTION OF THE INVENTION

Figure 2:
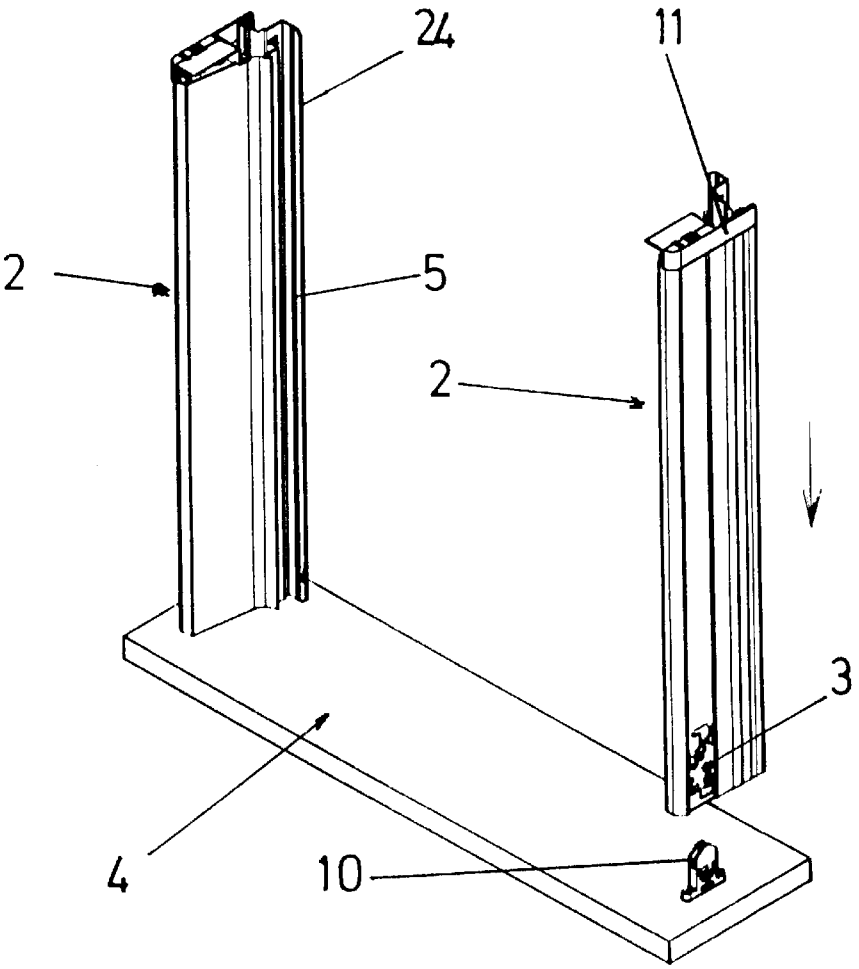
FIGS. 1 to 12 are perspective views of drawer sides, a drawer base, a rear wall and a front panel in various stages of assembly, FIGS. 3A and 3B being enlarged views of details A and B, respectively, in FIG. 3, FIGS. 6A and 6B being enlarged views of details C and D, respectively, in FIG. 6, and FIG. 12A being an enlarged view of detail E in FIG. 12.
Figure 1:
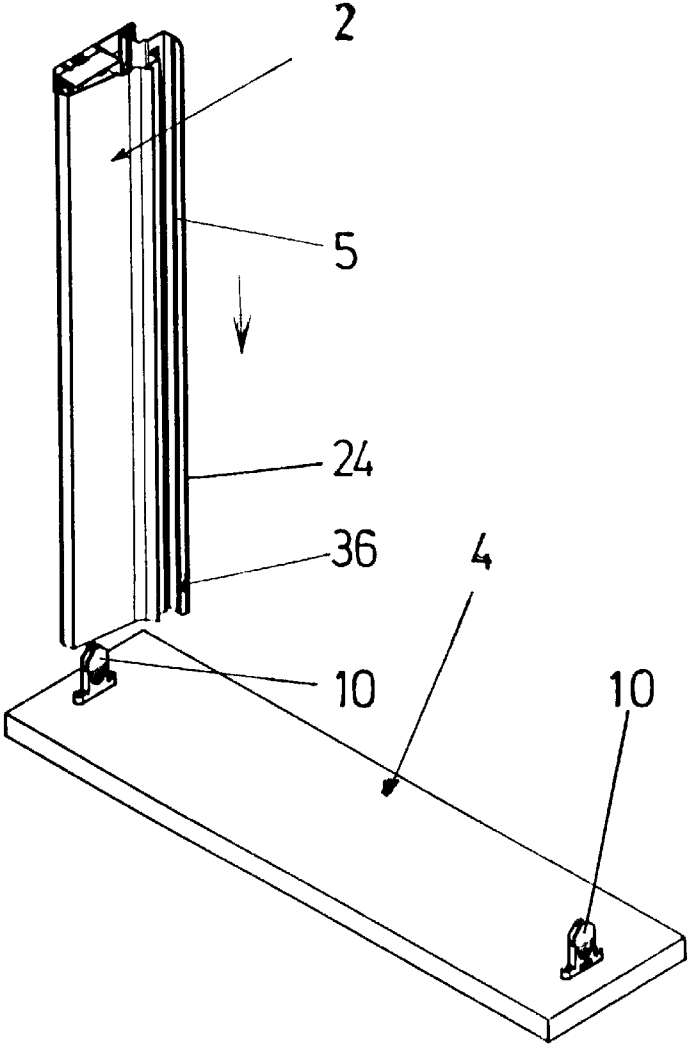

In a first example of a method of the invention, drawer sides 2 shown in FIGS. 1 and 2 are anchored to a front panel 4 by means of fixing devices. The fixing devices comprise a holding component 10 fixed to the front panel 4, for example by means of dowels 6, and a carrying component 3 fixed within the drawer side 2. The holding components 10 and the carrying components 3 are described in more detail below with reference to FIGS. 18 to 21.

Figure 3:
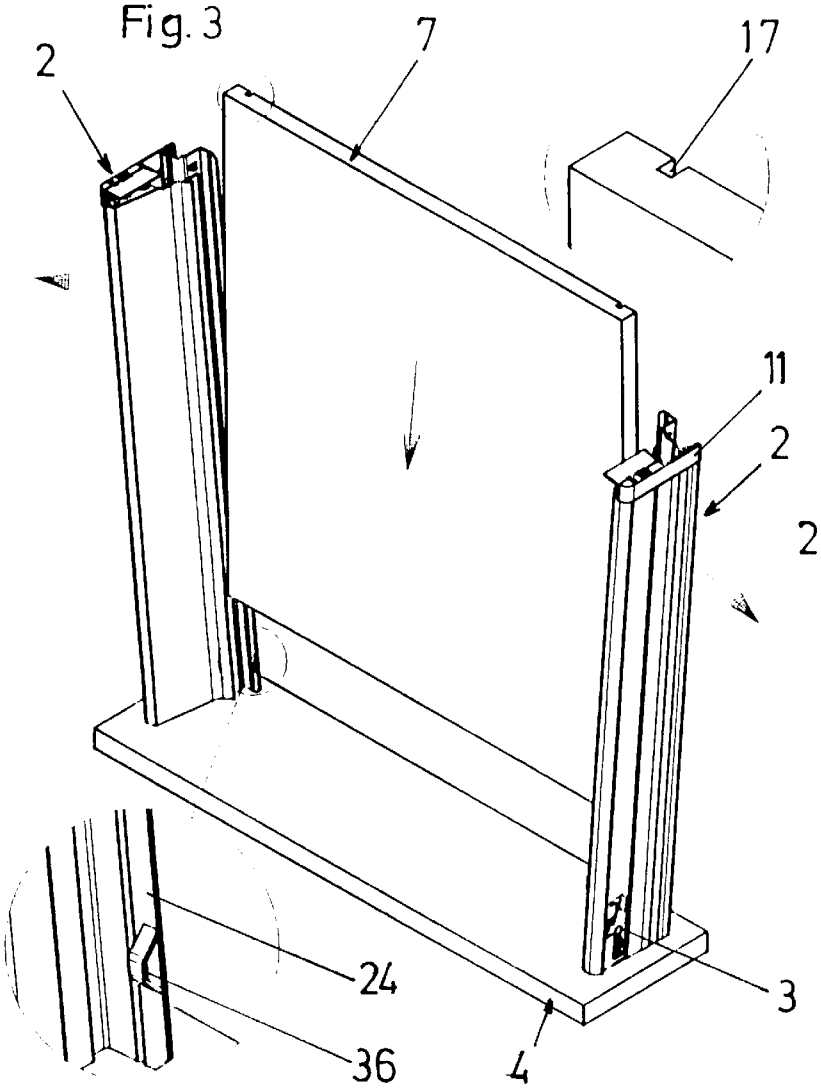

The drawer sides 2 have lateral U-shaped profiles defining spaces into which are fit respective lateral edge portions of the drawer base 7, as shown in FIG. 3. The drawer base 7 is provided on its underside or bottom surface with a longitudinal groove 17 for each drawer side 2.

Figure 4:
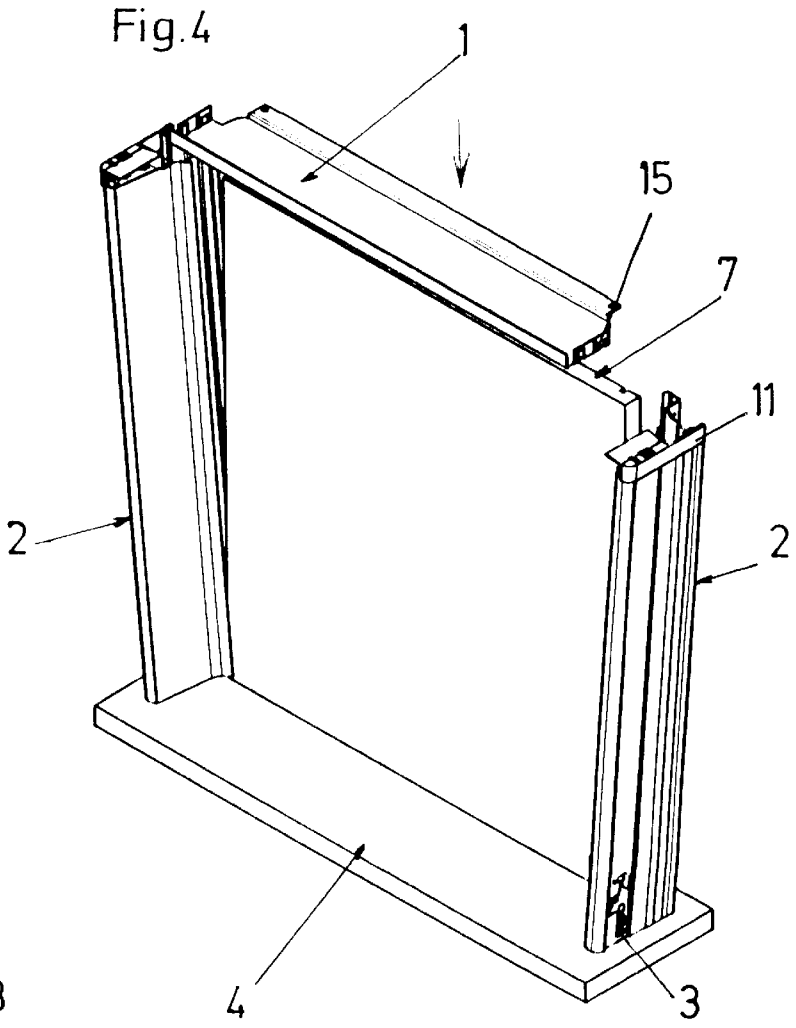
Figure 5:
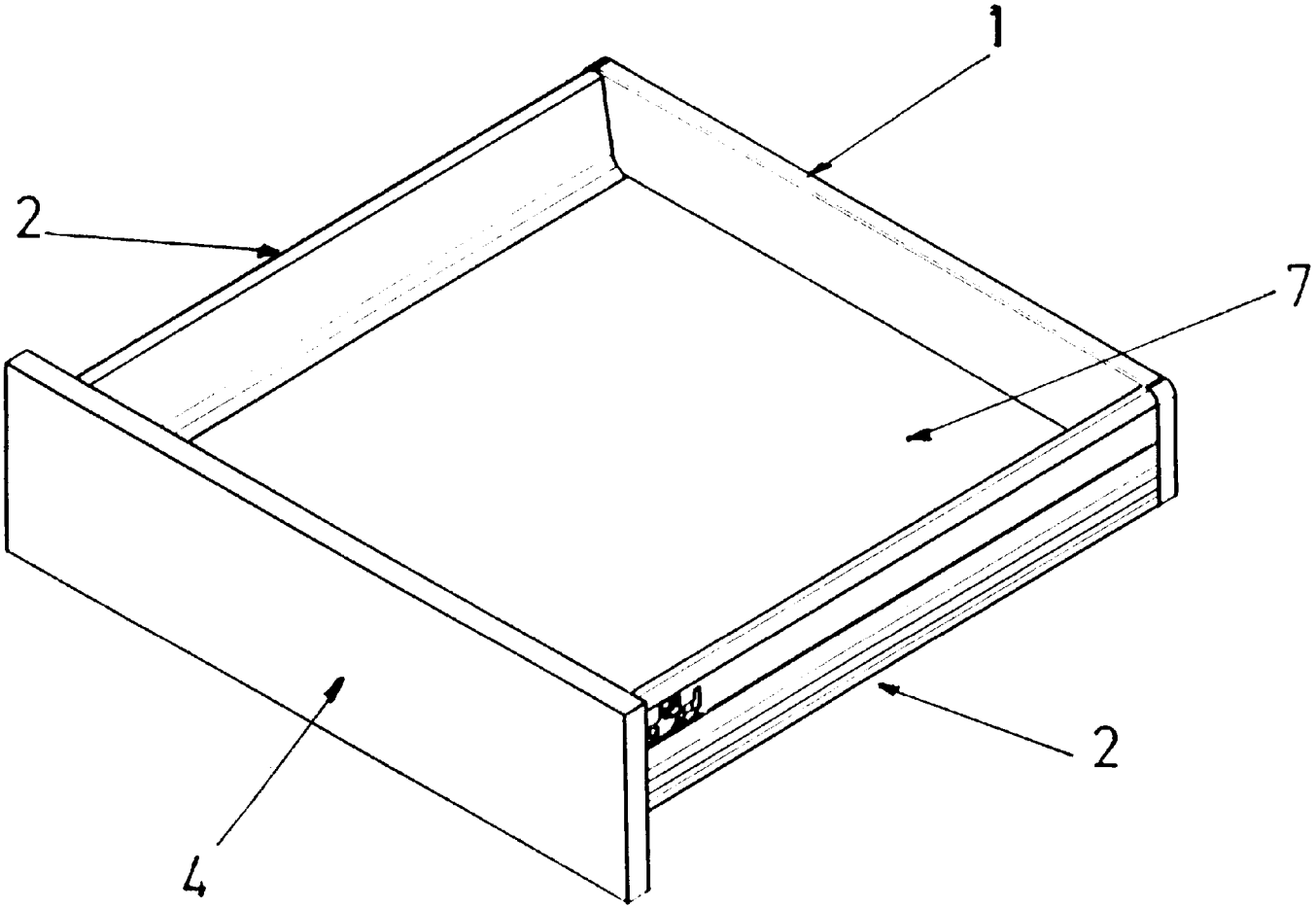

Lower horizontal bars or flanges 24 of profiles 5 of the drawer sides 2 are each provided with a single projection 36, 37, 38, 39, 40 (FIGS. 12–17), which is positioned at the front end of the profile 5 or of the horizontal bar or flange 24. With the drawer base 7 inserted, these projections 36, 37, 38, 39, 40 project into the grooves 17 of the drawer base 7. After insertion of the drawer base 7, the rear ends of the drawer sides 2, as shown in FIG. 4, are pushed slightly apart so that the rear wall 1 can be inserted between the drawer sides 2. It is possible for the drawer sides 2 to be pushed apart because the carrying components 3 of the fixing devices allow the drawer sides 2 to be lifted slightly from the front panel 4 without the drawer sides 2 being detached from anchoring with the front panel 4. The drawer sides 2 are provided, at their rear ends, with holding components 11 which have projecting pegs which snap into holes in flanges 15 of the rear wall 1. The drawer sides 2 and the rear wall 1 are thus held by a snap connection when the drawer sides 2 are pressed onto the rear wall 1. FIG. 5 shows the assembled drawer.

Figure 7:
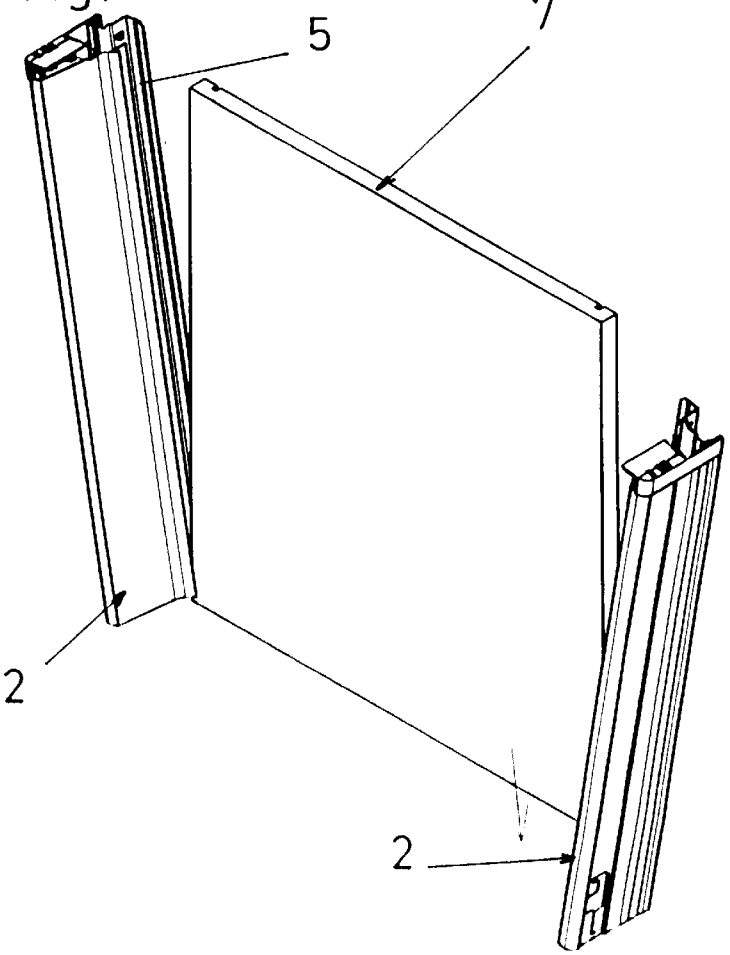
Figure 6:
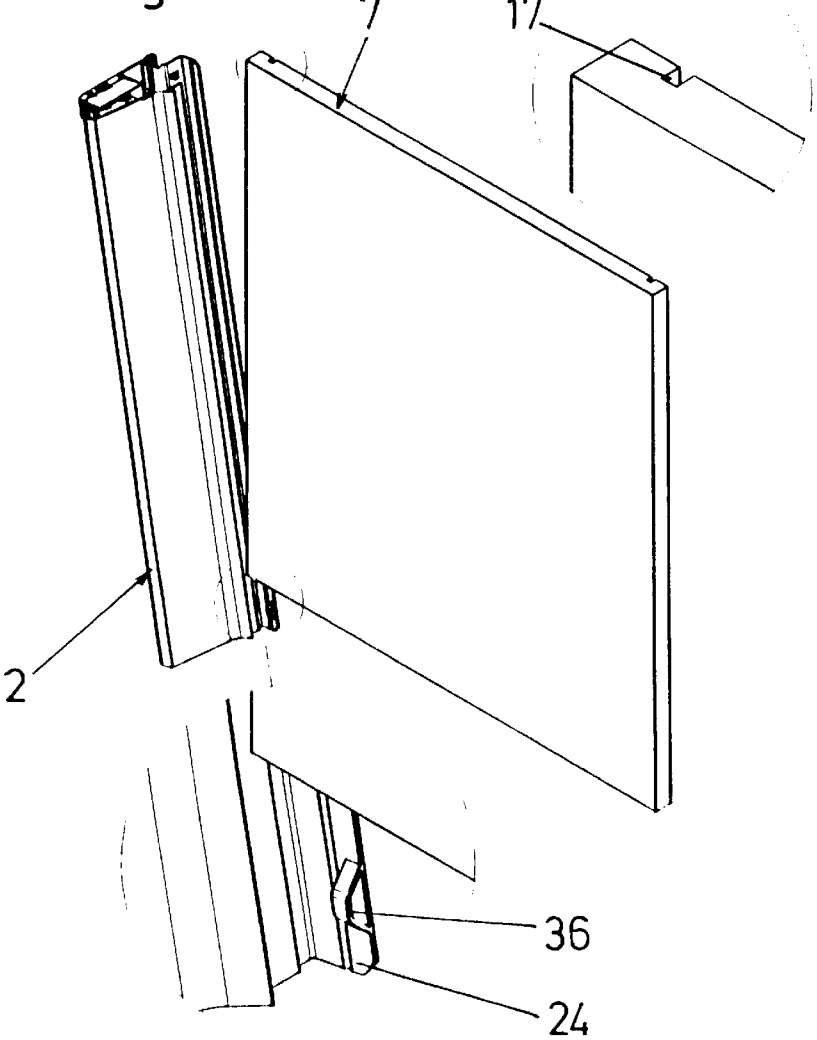
Figure 9:
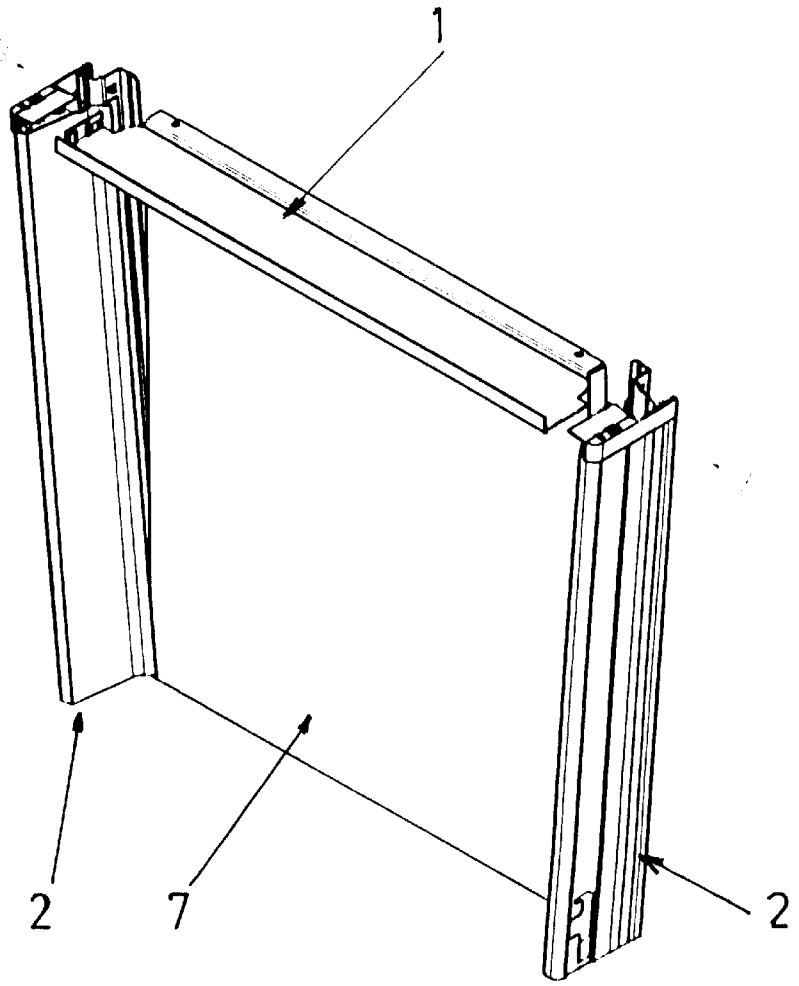
Figure 8:
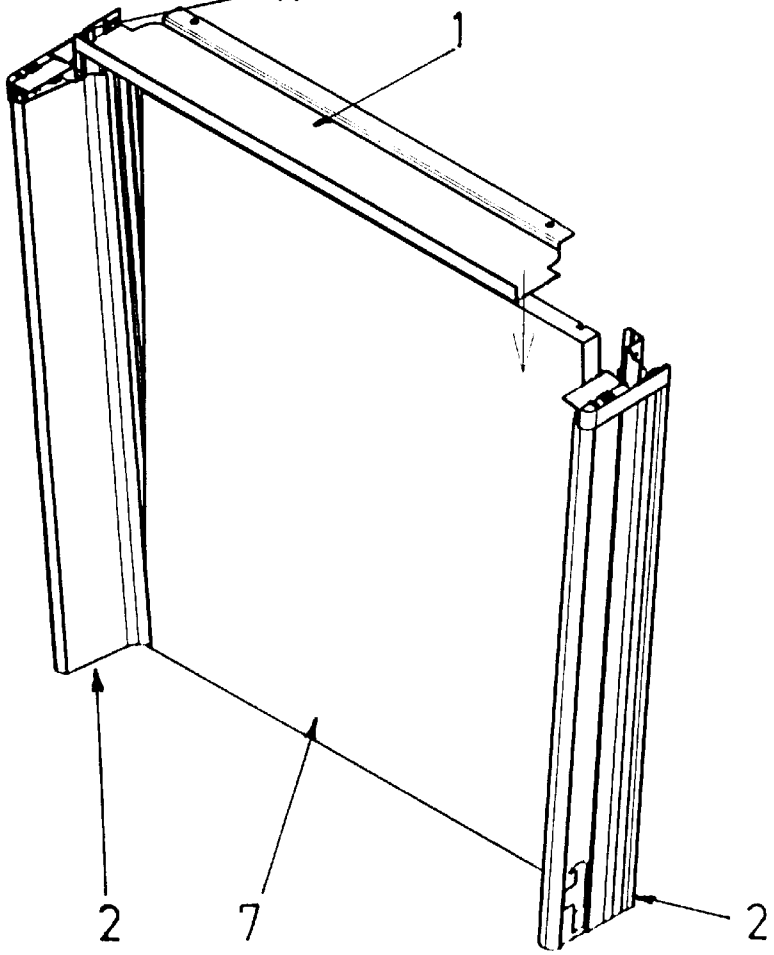

In the embodiment according to FIGS. 6 to 12, the drawer sides 2 are pushed laterally onto the drawer base 7. The bars or flanges 24 of the U-shaped profiles 5, which are open inwardly, of the drawer sides 2 each are provided with a single projection 36, 37, 38, 39, 40, which projects into a respective groove 17 on the underside of the base plate 7. The drawer sides 2, as shown in FIGS. 7 and 8, can in this way be tilted at their rear ends slightly outwardly, so that the rear wall 1 can be inserted between the drawer sides 2. The drawer sides 2 are provided, at their rear ends, with holding components 11 which allow the drawer sides to be locked with the rear wall 1. The rear wall 1 can have a flange 15 which is bent back at a right angle to the rear wall 1 and provided, for example, with holes into which the pegs of the holding components 11 snap. A bar or flange 20 of the holding component 11 grips behind the rear wall 1.

Figure 11:
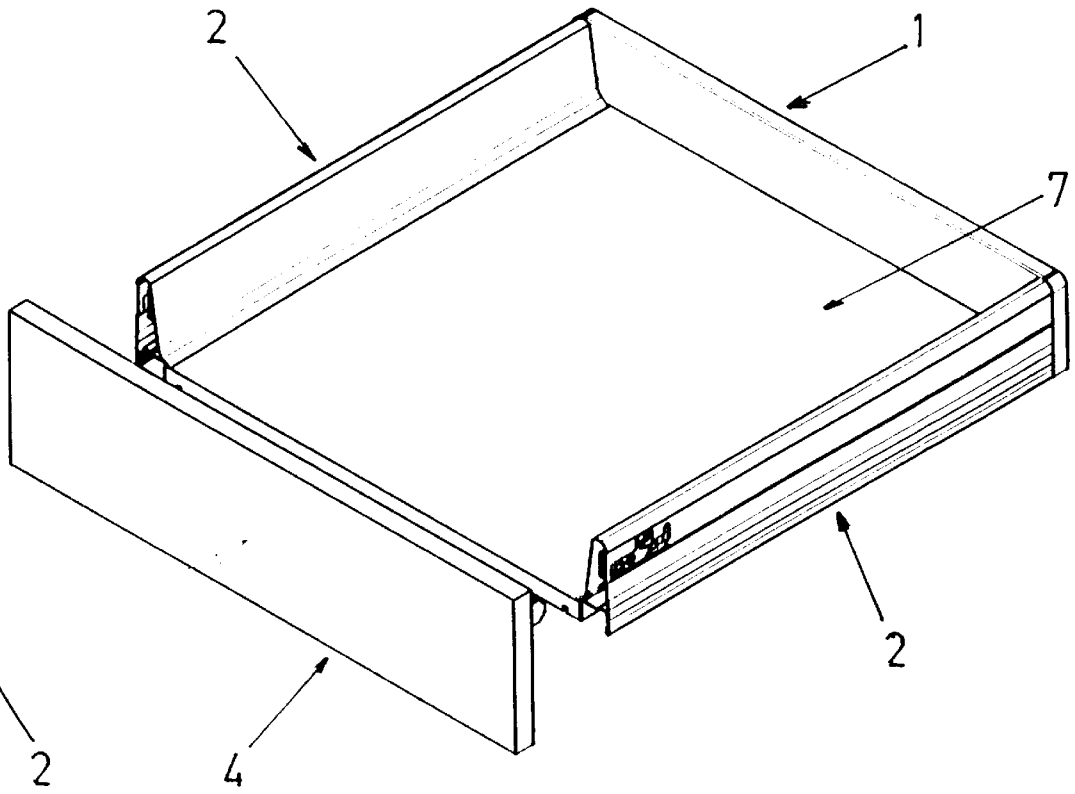
Figure 10:
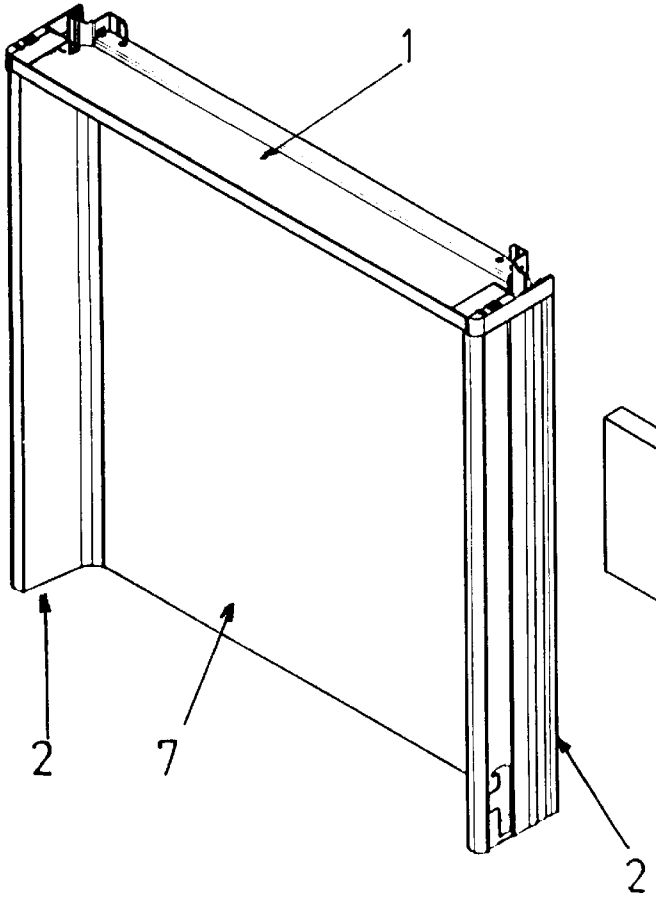

When the rear wall 1, the drawer sides 2 and the drawer base 7 are combined, as shown in FIG. 10, the front panel 4, as shown in FIG. 11, can be pushed onto the drawer sides 2, the holding components 10 being hung in the carrying components 3. In principle, the same fixing devices as in the previous embodiment can be employed. However, it is not necessary for it to be possible for the front panel 4 to be lifted slightly from the drawer sides 2 in the anchored state.

Figure 12:
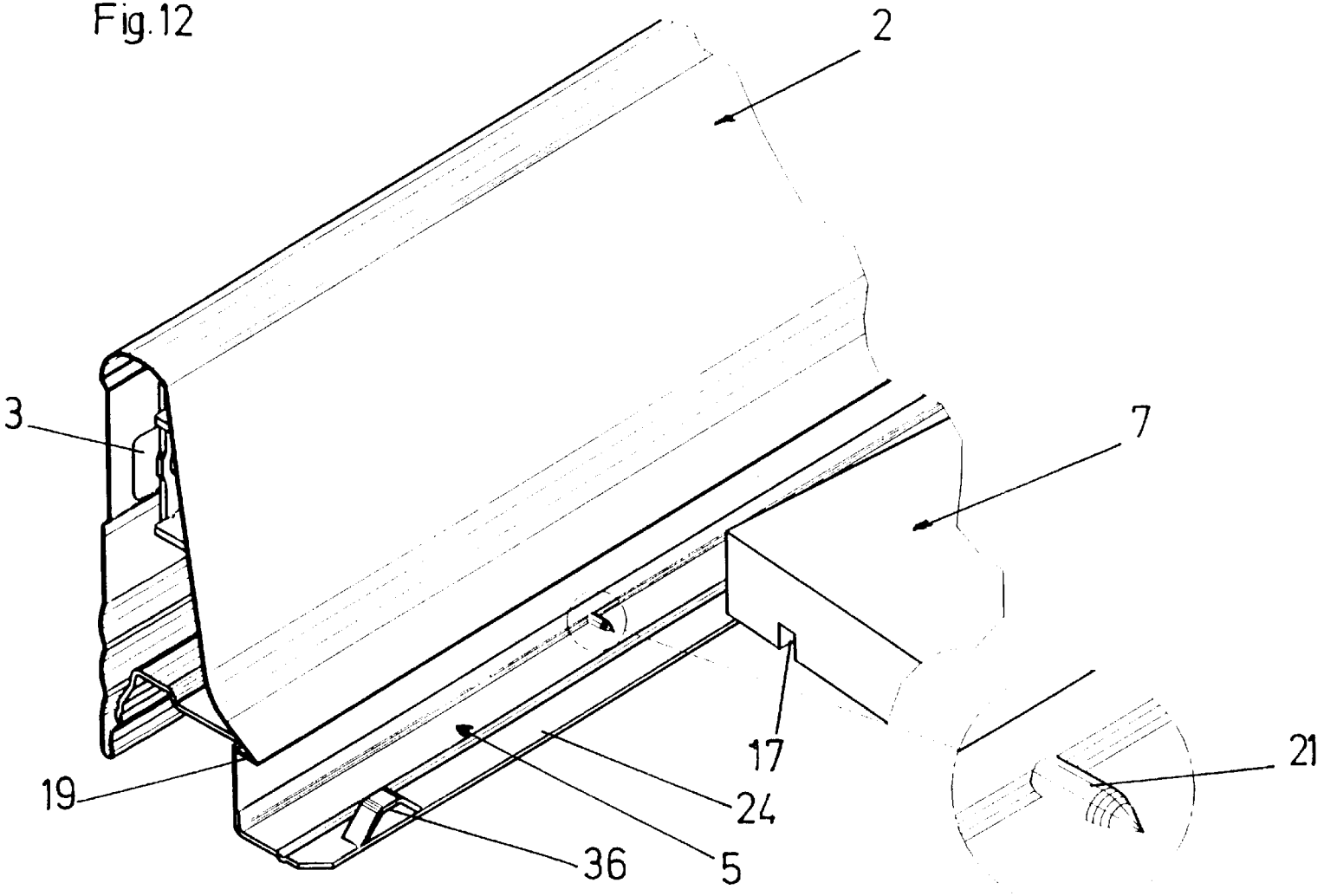
Figure 14:
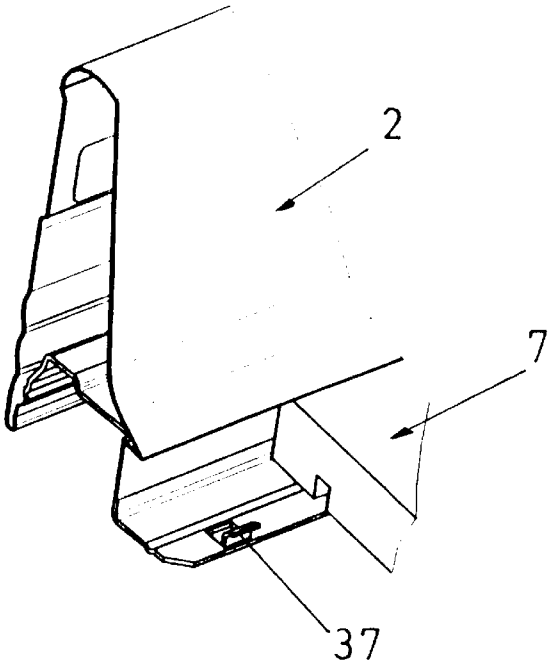
FIGS. 13 to 17 are perspective views of front ends of drawer sides having projections of different constructions.
Figure 15:
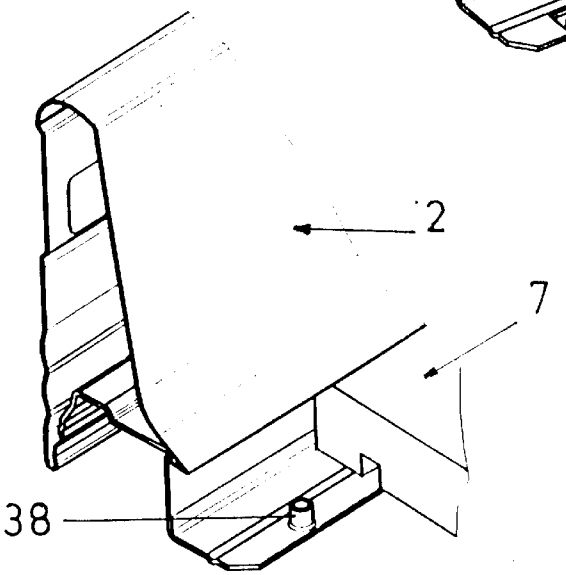
Figure 13:
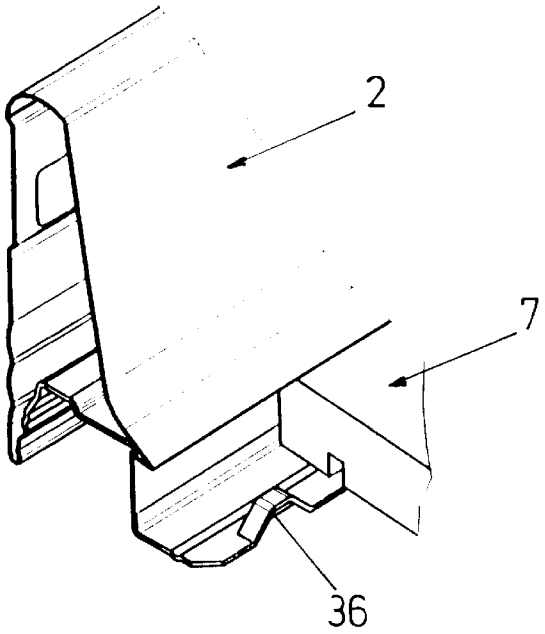
Figure 17:
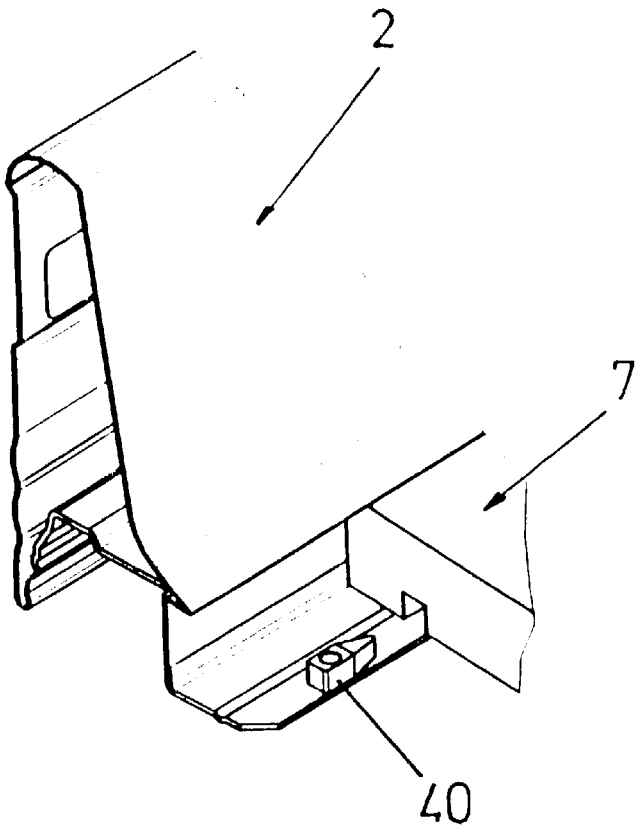
Figure 16:
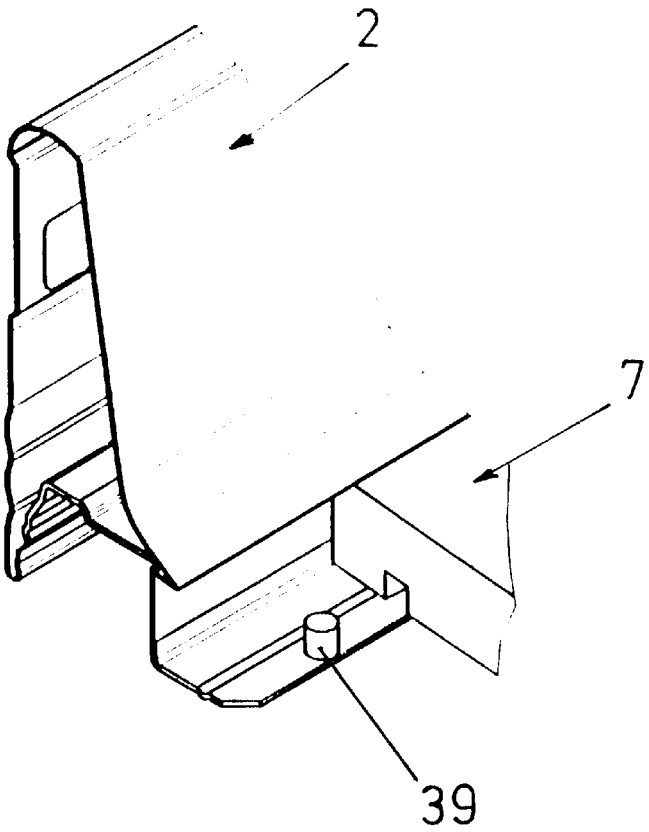

So that the drawer base 7 lies closely against an upper flange or lip 19 of the drawer side 2, protrusions or bulges 21 are constructed in the lower horizontal bar or flange 24 of the profile 5, on which bulges the drawer base 7 lies (FIGS. 12 and 12A). Several bulges 21 are distributed over the length of the horizontal bar or flange 24.

Figure 18:
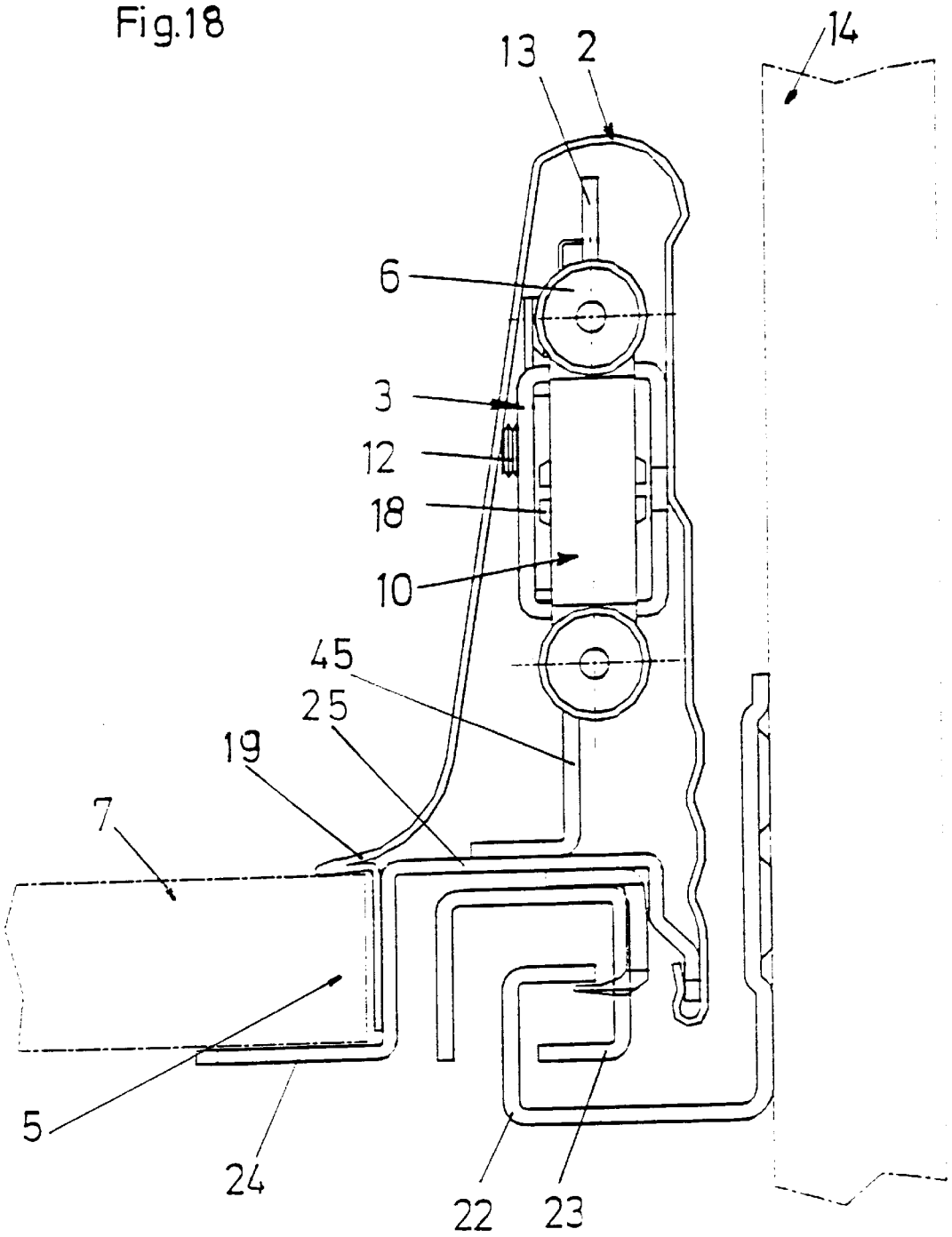
FIG. 18 is a front view of a drawer side with a holding device for a front panel inserted therein.

Various embodiments of the projections 36 to 40 are shown in FIGS. 13 to 17. The projection 36 is constructed in the form of a bridge or wedge that is stamped out of the horizontal bar or flange 24. The projection 37 is likewise stamped out of the horizontal bar or flange 24, but in a front view of the drawer side 2 is L-shaped in construction. The projections 38, 39 are constructed cylindrically, the projection 38 being a hollow cylinder. The projection 40 is formed from a separate block, for example of plastic, and is wedge-shaped, the wedge pointing to the rear. The fixing devices with which the front panel 4 can be anchored to the drawer sides 2 are constructed as follows. The holding component 10 is fixed to the front panel 4 by means of dowels 6 (FIG. 18). Carrying component 3 is fixed directly to an adaptor 25 inserted into the drawer side 2. Adapter 25, as shown in FIG. 18, is fixed to a pull-out rail 23 that slides along a supporting rail 22 mounted on furniture wall 14. An adjusting screw 18 for lateral adjustment of the front panel 4 is mounted in the holding component 10. The carrying component 3 is constructed in two parts with a bracket 45 which can be fixed directly to the adaptor 25 and a carrying plate 46 on which a rocking lever 13 is mounted. The carrying plate 46 has at the rear thereof an angled flange 30 on which a spring 8 is supported. The angled flange 30 is provided with a hole 29 through which projects a rod 9 which carries the spring 8 and acts directly on the rocking lever 13. The carrying plate 46 is fixed by means of height-adjustment screw 12 which projects through a longitudinal hole in the carrying plate 46 and which can be screwed into the bracket 45. The rocking lever 13 has an upper notch 49 and a lower notch 50. Above the rocking lever 13 is a safety catch 52 having a rear end having a hole 53 through which extends the rod 9 and a front end having a stop bar 62 which snaps into the notch 49 of the rocking lever 13 when the front panel 4 is fixed.

The carrying plate 46 has upper and lower horizontal bars or flanges 54, 55, between which the holding component 10 can be pushed. A lateral limiting bar or flange lies adjacent to the upper horizontal bar or flange 54, so that the holding component 10 is held between the bars or flanges 54, 55 and such lateral flange actual carrying plate. The carrying plate and lateral flange have punched holes through which projects pin 65 which forms the axis of the rocking lever 13. The holding component 10 is provided with a hook 58.

Figures 19, 20, 21:
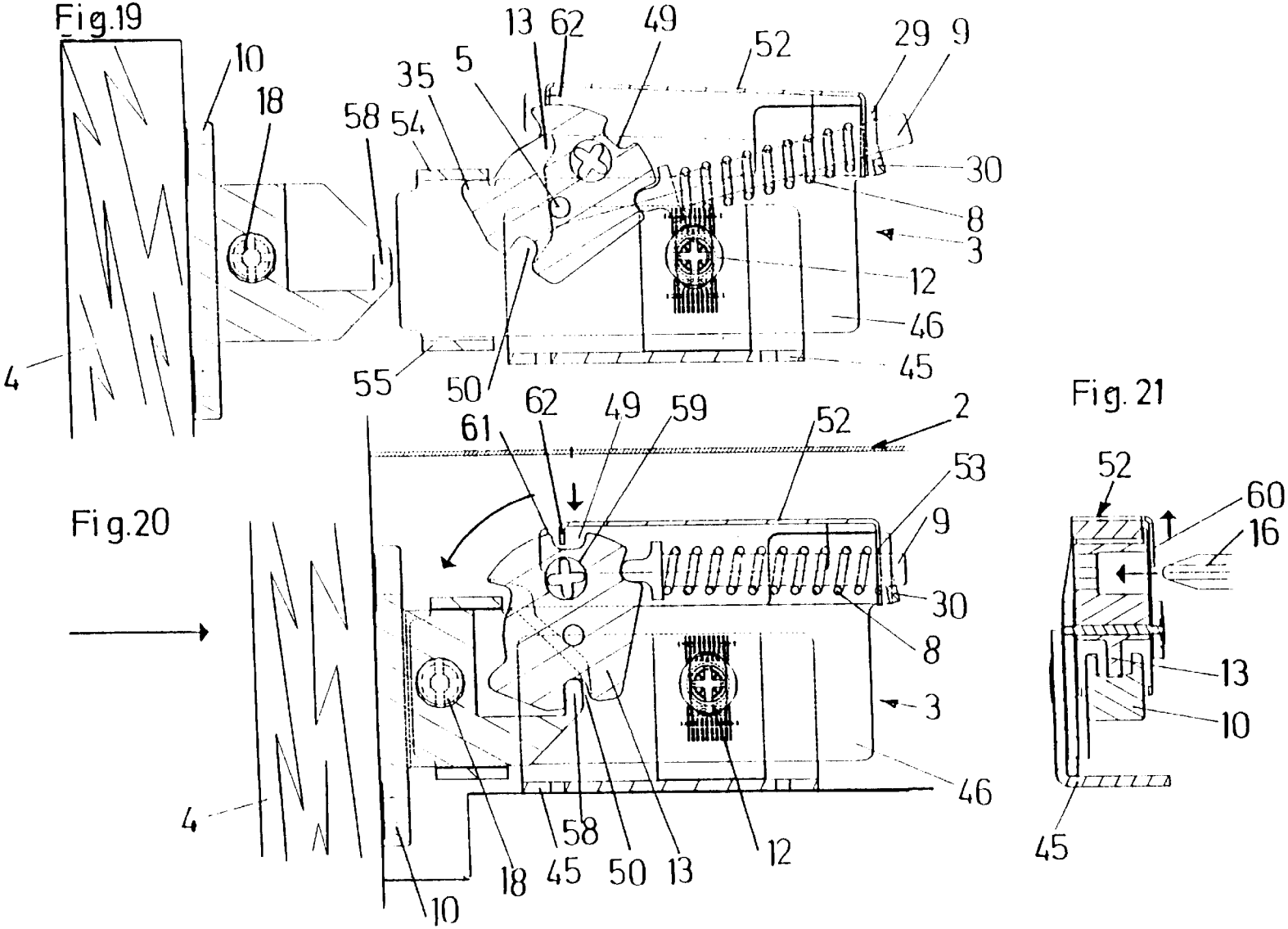
FIG. 19 is a section through a holding device and a front panel before the front panel is hung in the holding device.
FIG. 20 is a section as in FIG. 19 but with the front panel being hung.
FIG. 21 is a cross-section through the holding device in the region of a tilting segment.

Before the holding component 10 has been pushed into the carrying component 3, the rocking lever 13 is in the position shown in FIG. 19, i.e. it is acted on by the spring 8 in the clockwise direction and is turned until a nose 35 abuts bar or flange 54. When the holding component 10 is pushed into the carrying component 3, the hook 58 snaps into the notch 50 and turns the rocking lever 13 in the counterclockwise direction. This pivots rod 9 and spring 8 until spring 8 passes a dead center position. Then rocking lever 13 is likewise turned by the spring 8 in the counterclockwise direction and the holding component 10 is thus drawn into the carrying component 3 and the front panel 4 is pulled against front ends of the drawer sides 2.

The rocking lever 13 is provided with an opening 59, which is constructed cylindrically in an outer or front region and is in the form of a cross notch in an inner or rear region. The safety catch 52 has a lateral bar 60 which grips laterally over the rocking lever 13. If the front panel 4 is to be detached from the drawer side 2, a Phillips screwdriver 16 is inserted into the opening 59. The safety catch 52 is lifted in this way, since the screwdriver 16 pushes up the lateral bar 60. At the same time, the stop bar 62 is lifted from the notch 49 of the rocking lever 13 and the rocking lever 13 is thus released. When the Phillips screwdriver 16 projects into the cross notch region of the opening 59, the rocking lever 13 can be turned in the clockwise direction, whereby the holding component 10 is released.

With the front panel 4 mounted, the stop bar 62 of the safety catch 52 and corresponding stop faces 61 of the notch 49 of the rocking lever 13 are spaced from one another, so that a shock absorber effect occurs if a drawer is pushed too forcefully into a furniture body. When the front panel 4 pushes against side walls 14 of the furniture body, the drawer sides 2 can be lifted from the front panel 4 against the pressure of the springs 8 to the extent allowed by the distance between the stop bars 62 and the respective stop faces 61. Thereafter, the drawer sides 2 again are pushed against the front panel 4 by the springs 8. In the first method for assembling the drawer, this effect is utilized so that the drawer sides 2 anchored to the front panel 4 can be pushed rearwardly.

I claim:

1. A drawer comprising:

a front panel;

a rear wall;

two drawer sides extending between said front panel and said rear wall, each said drawer side being connected to said front panel by a respective fixing device, each said drawer side having extending laterally inwardly thereof a lower horizontal flange and an upper horizontal lip defining therebetween a space, each said horizontal flange having extending upwardly therefrom only a single projection, said single projection of each said horizontal flange being located adjacent a front end thereof;

a drawer base having a bottom surface, opposite lateral edge portions and grooves formed in said bottom surface at respective said lateral edge portions;

said drawer base being mounted on said drawer sides with said lateral edge portions extending into respective said spaces, with said lateral edge portions being supported by respective said lower horizontal flanges therebeneath with said grooves facing downwardly, and with each said single projection fitting into a respective said groove thereabove; and each said fixing device including a non-rigid structure sufficient to enable, during assembly of said drawer and before mounting of said rear wall, tilting of said side walls away from each other without separation of said side walls from said front panel.

2. A drawer as claimed in claim 1, wherein each said projection is bow-shaped.

3. A drawer as claimed in claim 1, wherein each said projection is cylindrical.

4. A drawer as claimed in claim 1, wherein each said projection is wedge-shaped.

5. A drawer as claimed in claim 1, wherein each said horizontal flange has upwardly protruding bulges contacting said bottom surface of said drawer base.

6. A drawer as claimed in claim 5, wherein each said bulge is elongated at a right angle to a longitudinal direction of the respective said horizontal flange.

* * * * *